US012181209B2

(12) United States Patent
Elser et al.

(10) Patent No.: US 12,181,209 B2
(45) Date of Patent: Dec. 31, 2024

(54) HOUSEHOLD APPLIANCE INCLUDING A WALL WHICH HAS AN INTEGRATED RAISED COUPLING ELEMENT FOR COUPLING TO A BACKING PART MOUNTED THEREON, AND METHOD FOR MOUNTING THE COUPLING ELEMENT ON THE WALL

(71) Applicant: BSH HAUSGERAETE GMBH, Munich (DE)

(72) Inventors: Oliver Elser, Koenigsbronn (DE); Siegfried Hoser, Burgau (DE); Simon Kraemer, Aalen (DE)

(73) Assignee: BSH Hausgeraete GmbH, Munich (DE)

( * ) Notice: Subject to any disclaimer, the term of this patent is extended or adjusted under 35 U.S.C. 154(b) by 1130 days.

(21) Appl. No.: 17/042,583

(22) PCT Filed: Jan. 9, 2019

(86) PCT No.: PCT/EP2019/050377
§ 371 (c)(1),
(2) Date: Sep. 28, 2020

(87) PCT Pub. No.: WO2019/185206
PCT Pub. Date: Oct. 3, 2019

(65) Prior Publication Data

US 2021/0123662 A1 Apr. 29, 2021

(30) Foreign Application Priority Data

Mar. 27, 2018 (DE) ..... 102018204658

(51) Int. Cl.
*F25D 23/06* (2006.01)
*F25D 23/10* (2006.01)
*A47B 88/43* (2017.01)

(52) U.S. Cl.
CPC ..... *F25D 23/067* (2013.01); *F25D 23/066* (2013.01); *F25D 23/10* (2013.01);
(Continued)

(58) Field of Classification Search
CPC ..... F25D 23/062; F25D 23/067; F25D 25/02; F25D 2325/021; F25D 2325/023;
(Continued)

(56) References Cited

U.S. PATENT DOCUMENTS 2,657,894 A * 11/1953 Sklenar ..... F25D 23/067 248/222.12
3,038,774 A * 6/1962 Cyrus ..... A47B 88/43 312/350
(Continued)

FOREIGN PATENT DOCUMENTS

CN 1238037 A 12/1999
CN 101087984 A 12/2007
(Continued)

OTHER PUBLICATIONS

"Cupola" Wikipedia, The Free Encyclopedia, Wikimedia Foundation, Retreived Dec. 15, 2023 at https://en.wikipedia.org/wiki/Cupola.*

*Primary Examiner* — Jerry-Daryl Fletcher
*Assistant Examiner* — Daniel C Comings
(74) *Attorney, Agent, or Firm* — Laurence A. Greenberg; Werner H. Stemer; Ralph E. Locher

(57) ABSTRACT

A household appliance, in particular a household refrigerator, includes a receiving space, in particular for food, which is delimited by walls of the household appliance. A backing part is mounted on an outer side of one of the walls facing away from the receiving space. The backing part has a coupling element which, when the backing part is mounted on the outer side, is coupled to a counter-coupling element
(Continued)

which is on the outer side. The counter-coupling element is constructed as a raised cup without holes, and the coupling element is constructed as a receptacle through which the cup extends in the mounted state. A method for mounting a backing part on a wall of a household appliance is also provided.

13 Claims, 6 Drawing Sheets

(52) U.S. Cl.
CPC ..... *A47B 88/43* (2017.01); *A47B 2210/175* (2013.01); *F25D 2323/021* (2013.01)

(58) Field of Classification Search
CPC .... F25D 25/025; F25D 23/021; F25D 23/066; F25D 2323/06; A47B 88/43; A47B 2210/175
See application file for complete search history.

(56) References Cited

U.S. PATENT DOCUMENTS 3,352,431 A * 11/1967 Smith ..... F25D 25/02 312/351
3,724,989 A * 4/1973 Houghton ..... F25D 23/064 425/388
4,195,888 A * 4/1980 Squire ..... F25D 23/067 248/235
4,528,825 A * 7/1985 Khan ..... F25D 25/02 312/313
5,855,424 A * 1/1999 Hamilton ..... F25D 23/067 62/298
6,158,609 A 12/2000 Kaiser
8,052,237 B2 11/2011 Althammer et al.
8,197,019 B2 * 6/2012 Kim ..... F25D 23/067 312/401
2003/0111943 A1 * 6/2003 Banicevic ..... F25D 25/025 312/348.4
2007/0163083 A1 7/2007 Eberl
2008/0048540 A1 2/2008 Kim
2016/0025405 A1 1/2016 Park et al.

FOREIGN PATENT DOCUMENTS

CN 102007355 A 4/2011
CN 102109265 A 6/2011
CN 102374737 A * 3/2012 ..... F25D 23/10
DE 102014203619 A1 8/2015
JP S5416773 A 2/1979
JP H10339563 A 12/1998
JP 2001012845 A 1/2001
WO 2011080654 A2 7/2011

* cited by examiner

HOUSEHOLD APPLIANCE INCLUDING A WALL WHICH HAS AN INTEGRATED RAISED COUPLING ELEMENT FOR COUPLING TO A BACKING PART MOUNTED THEREON, AND METHOD FOR MOUNTING THE COUPLING ELEMENT ON THE WALL

BACKGROUND OF THE INVENTION

Field of the Invention

The invention relates to a household appliance, in particular a household refrigeration appliance, comprising a receiving space, in particular for food, which is delimited by walls of the household appliance, and comprising a backing part which is mounted on an outer side of one of said walls, said outer side facing away from the receiving space, wherein the backing part has a coupling element which, when the backing part is mounted on the outer side, is coupled to a counter-coupling element which is on the outer side. The invention further relates to a method for mounting a backing part.

An embodiment comprising a backing part on an internal container is disclosed, for example, in WO 2011/080654 A2. In this case, a wall of the internal container is designed with a hole and thus an opening. A pin of the backing part extends into this hole. The backing part bears directly against an outer side of the wall. No further element is arranged between the hole and the pin. An internal container of a household refrigeration appliance is generally designed from plastic material, so that the direct fastening of further components thereto is limited. Functional components such as a rail pull-out device, on which in turn further different components such as shelves or receptacles for food may be placed, have a corresponding weight which thus also acts on the fastening arrangement. Specifically in this context it is known from the prior art to use such a rail-shaped backing part, which is designed from metal, in addition to this side wall in order to be able to fasten securely and reliably thereto the functional component which is separate therefrom, and in this context also to provide that correspondingly greater weight forces may be absorbed. Thus by means of this backing part a concept is also effectively formed in which the side wall as a load-bearing structure is relieved of load to a maximum extent and the actual main attachment of the functional component is carried out on this backing part. However, foam material which is introduced as thermal insulation material into an intermediate space between the internal container and an external housing may pass through the hole in the wall.

Since the position of the functional component to be attached is important in order to be able to provide unlimited functionality, it is also important that the backing part is able to be correspondingly accurately positioned. Due to manufacturing tolerances and mounting tolerances, however, deviations which may impair the functionality of the entire system may arise here.

SUMMARY OF THE INVENTION

It is the object of the present invention to provide a household appliance, in particular a household refrigeration appliance, and a method in which the positioning of a backing part is improved.

This object is achieved by a household appliance, in particular a household refrigeration appliance, and a method according to the independent claims.

One feature of the invention relates to a household appliance, in particular a household refrigeration appliance, comprising at least one receiving space, in particular for food. This receiving space is delimited by walls of the household appliance. The household appliance also has at least one separate backing part which is mounted on an outer side of one of said walls, said outer side facing away from the receiving space. The backing part has at least one coupling element which is designed in an integrated manner and thus in one piece therewith and which, when the backing part is in the mounted state on this outer side, is coupled to a counter-coupling element which is designed on the outer side of the wall. The counter-coupling element is designed as a raised cup without holes. The coupling element is designed as a hole and thus as a continuous aperture through which the cup extends in the mounted state. The cup which may also be denoted as a dome or cupola, therefore, is also designed as a fully closed raised portion per se. By means of such an embodiment, the wall at least in the region of this counter-coupling element, and the counter-coupling element itself, may be designed without interruptions. Thus it is achieved that this counter-coupling element is designed to be very stable per se. Moreover, it is possible to avoid that dust or dirt could penetrate through the wall in the region of the coupling between the counter-coupling element and the coupling element. Moreover, it is also achieved that thermal insulation material which is optionally present in the region of the outer side, such as for example an insulating foam, is not able to penetrate through the wall in the region of the coupling between the counter-coupling element and the coupling element.

It may be provided that a further separate element is not arranged between the counter-coupling element and the coupling element. Thus the coupling element and the counter-coupling element bear directly against one another.

It may be provided that the cup is designed as a deep-drawn cup. Thus the cup is configured by deep-drawing. By means of such an embodiment, during the production process of the wall which is produced by deep-drawing, the cup may be produced therewith. A simple and rapid manufacture is permitted thereby. The wall together with the cup may also be produced by injection-molding.

It may be provided that the cup is designed in cupola-like manner. This means, in particular, that it has a jacket wall without corners and it also has a top wall without corners which is curved, in particular, in a convex manner in one direction. By means of such an embodiment, it is possible to implement the coupling to the coupling element in a simple manner. Moreover, the production is also simpler since due to this geometry no undesired edges and burrs are present.

It may be provided that the receptacle is designed as a hole or opening. Preferably, the hole or the opening is closed at the edge, i.e. over the periphery. The hole or the opening may be stamped, in particular when the backing part consists of metal. It may also be provided that the receptacle is formed by a pocket or a cup-shaped element or by a blind hole. In this case, the pocket or the cup-shaped element or the blind hole may have a receptacle opening.

It may be provided that the receptacle, for example the coupling element designed as a hole, is designed in a funnel-like manner. This means that, viewed in the direction of a receptacle axis, for example a hole axis, this receptacle, for example this hole, has a certain depth and tapers at least partially relative thereto. This is advantageous in that the width of the receptacle and/or the hole is designed to be larger at a funnel inlet (for example receptacle opening) than at a funnel base. In particular, in the case of a hole as a receptacle the funnel base has an opening and/or a cutout through which the cup also extends when the fully mounted state is reached. By means of such an embodiment, therefore, the insertion of the cup into the receptacle and, in the case of a hole as the receptacle, through the cutout in the funnel base, may be carried out in an improved manner.

This is advantageous in that in the case of a cup, in particular when produced by deep-drawing, a discrete edge is not present at the transition to the wall but there is a certain radius. Thus in order not to produce an interfering stop of the edge of the receptacle opening and/or in the case of a hole, of the edge and/or of the cutout of the hole, on such a radius of the cup on the outer side, the aforementioned shape of the receptacle and/or the hole is particularly advantageous regarding a positionally accurate mounting of the backing part on the wall. Thus viewed in the direction of the receptacle axis and/or the hole axis, the cutout and thus also the funnel base are spaced apart from this radius on the outer side of the cup and/or at the transition of the cup to the planar region of the wall. As a result, it is possible to avoid an interfering and incomplete bearing of the backing part against the wall. Moreover, if required, it is possible to avoid thereby undesired removal of material during mounting, for example by shearing off with the edge of the boundary, which delimits the cutout, on this radius at the transition between the jacket wall of the cup and the further wall region of the wall.

It may be provided that the funnel shape is designed by a step in the wall. This step, in particular, is formed by a stamped portion. As already set forth above, in the case of a hole as a receptacle, a cutout is preferably designed on the funnel base for passing through the cup. In particular, it is provided that the wall thickness of the backing part in those wall regions which delimit this funnel-shaped hole is equal over the entire depth of the hole. By means of the step which is preferably produced by stamping, therefore, a material thickening is not configured at any point. Thus the funnel base also has a thickness which corresponds to the thickness of the step and thus also the thickness of that wall region of the backing part which delimits the funnel region of the hole.

It may be provided that at least two separate cups which are positioned spaced apart from one another are designed in an integrated manner and thus in one piece in the wall on the outer side and a corresponding number of receptacles, for example holes, is designed in the backing part. By such a possibility of multiple coupling between a cup and a receptacle, the fastening of a backing part is improved. The positionally accurate and thus, in particular, also the rotationally free fastening of the backing part are made possible thereby.

It may be provided that the receptacles, for example the holes, have different geometries. Additionally or alternatively thereto it may be provided that the cups have different geometries. In particular, the jacket walls of the cups have different geometries, with an advantageous design relative thereto.

By means of such an embodiment having different geometries, on the one hand, in an advantageous design a mounting coding may be provided so that the backing part may also be mounted correctly on the outer side of the wall. Additionally or alternatively thereto, by means of such a different geometry it may also be achieved that it is possible to compensate for positioning and manufacturing tolerances in a simpler manner. Thus it may be provided that the geometry of a receptacle, for example of a hole, in which a cup is intended to penetrate, is different from the geometry of this cup. In particular, the geometry of the receptacle, for example of the hole, is different from a jacket wall of the cup. By means of such an embodiment of different geometries of a receptacle from a cup to be coupled into this receptacle, the positioning and individual locating of the backing part may be improved. It is also possible to compensate for mounting tolerances and manufacturing tolerances in a simple manner thereby.

It may be provided that, for example the first receptacle, for example the first hole, in particular in a receptacle opening or in the case of a hole in a cutout for passing through a cup, has a circular geometry and the second receptacle, for example the second hole, in particular in a receptacle opening or in the case of a hole in a cutout for passing through a cup, has an irregular circular shape. An irregular circular shape may be, for example, an oval or elliptical or even any other type of geometry which is designed, in particular, without corners in its defining contour.

It may be provided that the first cup has an annular geometry on its jacket wall and the second cup has an irregular annular geometry of its jacket wall. In particular, it may be provided that the first receptacle, for example the first hole, is designed for receiving the first cup and the second receptacle, for example the second hole, is designed for receiving the second cup.

It may be provided that both the first cup has an annular geometry of its jacket wall and the second cup has an annular geometry of its jacket wall. In such an embodiment, therefore, the geometry of the first receptacle, for example of the first hole, and the first cup on its jacket wall correspond to one another, whereas the geometry of the second receptacle, for example of the second hole, and the geometry of the jacket wall of the second cup differ from one another. The aforementioned advantages may be achieved, in particular, thereby.

Similarly, however, it is also possible that the first receptacle and the second receptacle have equal, i.e. identical, geometries. For example, the first hole and the second hole may have equal hole geometries, in particular for example circular geometries, in particular in the cutout thereof, and a jacket wall of a cup has an annular geometry and the jacket wall of the other cup has an irregular annular geometry.

It may be provided that an irregular circular shape of a hole or a receptacle opening is without corners in its defining contour, for example is oval or elliptical. As a result, an elongated hole is formed by this irregular circular shape. By means of this elongated hole an overdetermination of the positioning is prevented and a tolerance compensation and a simplified mounting is permitted.

It may be provided that a coupling between a receptacle, for example a hole, and a cup is designed with asymmetrical play. Specifically by means of this embodiment the aforementioned advantages may be particularly achieved.

It may be provided that the further coupling between the other receptacle, for example the other hole, and the other cup, is designed with symmetrical play. As a result, the backing part as a whole may be positioned relative to the wall to a certain extent such that, on the one hand, as a whole it is arranged in a positionally accurate manner on the wall and, on the other hand, it may be arranged as far as possible over a large surface area of the outer side of the wall.

It may be provided that a screw receptacle which is separate from the coupling element is designed in the wall for screwing in a screw. The screw receptacle is designed, in particular, as a continuous opening. The screw receptacle may, however, also be designed as a blind hole. Preferably, the screw receptacle has an internal thread. A raised centering element, which is designed in an integrated manner in the wall and thus in one piece, is arranged so as to penetrate this screw receptacle, wherein a screw may be screwed through this centering element. This also means, therefore, in the basic embodiment that the centering element is designed to protrude in a raised manner over the surface area of the wall and is also designed to be without holes and/or without interruptions. In this state, therefore, when the backing part is connected to the outer side of the wall, the centering element penetrates this screw receptacle so that the positionally accurate arrangement of the backing part on the outer side is also further assisted thereby. Only by screwing in the screw, which involves a subsequent manufacturing step, is this centering element effectively punctured and only by the penetration of this screw is a hole then effectively produced in this centering element. Since this manufacturing step of the penetration of the screw, however, takes place after a foaming process and thus after introducing a thermal insulating foam into an intermediate space between an outer wall and the wall designed as an inner wall, therefore, in particular during this foaming process no foam material is able to penetrate through the wall in the region of this centering element.

Generally the backing part is mounted on the foam side of the wall. This means that this outer side of the wall, on which the backing part is arranged, faces toward this foam material. In the foamed state, the backing part is also covered by this foam material.

It may be provided that the household appliance has a drawer which is able to be pushed into and pulled out of the receiving space. The drawer has a front wall which in the pushed-in state of the drawer closes the receiving space on the front side. This front wall has an inner wall which faces toward the receiving space and which constitutes the wall on which the backing part is arranged on an outer side.

The receiving space is typically delimited by further walls which are a component of an internal container. The internal container is a separate component from the cited drawer and thus, in particular, a separate component from the wall on which the backing part is arranged.

It may be provided that a pull-out device is designed on the backing part for the linear displacement of the wall. The pull-out device may, for example, be a telescopic rail.

The household appliance may be, in particular, a household refrigeration appliance, a household cooking appliance, a household dishwashing appliance or a household washing appliance.

A further feature of the invention relates to a method for mounting a backing part on a wall of a household appliance, in particular a household refrigeration appliance, a receiving space of the household appliance being delimited thereby. The backing part is arranged on an outer side of this wall facing away from the receiving space, wherein the backing part is coupled by a coupling element with a counter-coupling element on the outer side. The counter-coupling element is inserted as a raised cup without holes into a coupling element designed as a hole.

In an advantageous embodiment of the method, a screw receptacle which is separate from a coupling element is designed on the wall for screwing in a screw, wherein a raised centering element without holes, which is designed in an integrated manner in the wall, is arranged so as to penetrate this screw receptacle, and subsequently a screw is screwed into the centering element without holes, penetrating said centering element without holes, and screwed in the screw receptacle.

Further advantageous embodiments of the method are provided by advantageous embodiments of the household appliance, in particular of the household refrigeration appliance, wherein in this case corresponding geometric embodiments and interactions of components to one another permit the respective method steps. In particular, reference may be made here to the respective geometries of holes and/or cups which thus permit a positionally accurate bearing of the backing part against the outer side of the wall over a maximum surface area.

The backing part is designed, in particular, from metal and, in particular, in one piece. The wall is produced, in particular, from plastic material, in particular by deep-drawing.

The positions and orientations provided when the appliance is used as intended and arranged as intended are specified by the terms "above", "below", "front", "rear", "horizontal", "vertical", "depth direction", "width direction", vertical direction".

Further features of the invention are disclosed in the claims, the figures and the description of the figures. The features and combinations of features cited above in the description, as well as the features and combinations of features cited hereinafter in the description of the figures and/or shown individually in the figures, are not only able to be used in the respectively specified combination but also in other combinations or individually without departing from the scope of the invention. Thus embodiments which are not explicitly shown and described in the figures but which emerge and are able to be generated from the described embodiments by separate combinations of features are also to be regarded as encompassed and disclosed by the invention. Embodiments and combinations of features which, therefore, do not comprise all of the features of an originally formulated independent claim are also to be regarded as disclosed.

Exemplary embodiments of the invention are described in more detail hereinafter with reference to schematic drawings.

DETAILED DESCRIPTION OF THE INVENTION

Figure 1:
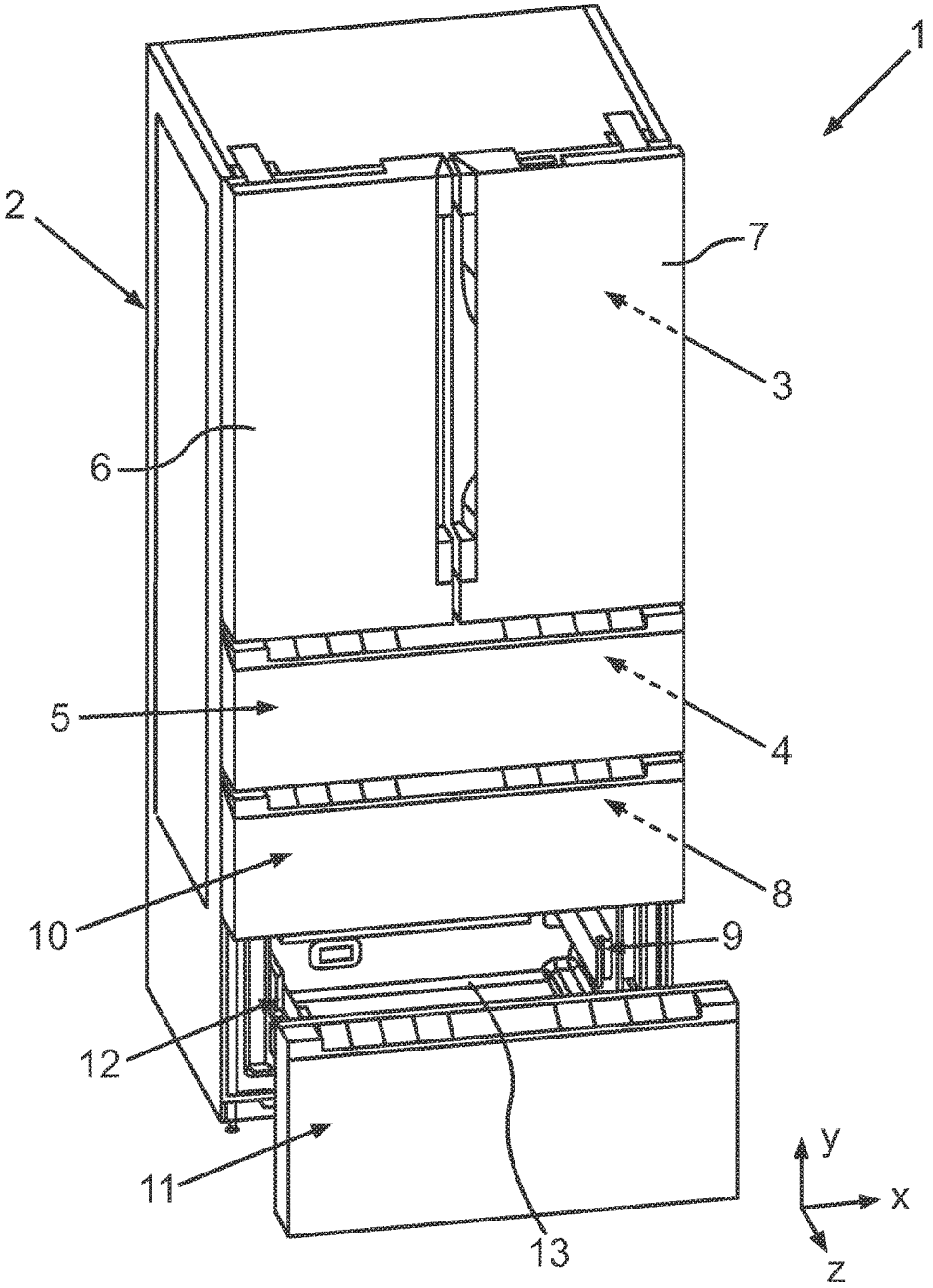
FIG. 1 shows a schematic perspective view of an exemplary embodiment of a household refrigeration appliance according to the invention.

Elements which are the same or functionally the same are provided with the same reference numerals in the figures.

A household appliance in the form of a household refrigeration appliance 1, which is designed for storing and conserving food, is shown in FIG. 1. In the exemplary embodiment the household refrigeration appliance 1 is designed as a combined refrigerator-freezer. The household refrigeration appliance 1 has a housing 2 in which a plurality of separate receiving spaces for food are designed. In this context, a first receiving space 3 is designed, which in the present exemplary embodiment is designed as a refrigeration compartment. Moreover, the household refrigeration appliance 1 comprises a fresh food compartment 4 which is designed therebelow in the vertical direction (y-direction) and which in this case represents a partial volume of the receiving space 3 and in which a different air humidity and/or a different temperature may be set from the remaining partial volume of the receiving space 3 located thereabove. The fresh food compartment may also be a separate receiving space.

In the exemplary embodiment it is provided that the receiving space 3 is able to be closed by a plurality of separate doors arranged on the front side. The fresh food compartment 4 in this context is closable by a door 5 which is a front wall of a drawer which is displaceable in a linear manner in the depth direction (z-direction). The remaining partial volume of the receiving space 3 is closable by two further separate doors 6 and 7, which are pivotable separately about vertical axes and thus axes oriented in the vertical direction and independently of one another. By means of this embodiment, on the one hand, the remaining partial volume of the receiving space 3 which is not formed by the fresh food compartment 4 may be opened and closed independently of the fresh food compartment 4, which is carried out by corresponding pivoting of the doors 6 and/or 7. In turn, independently thereof, the fresh food compartment 4 may be opened by the door 5 being opened and thus the drawer being pulled out.

The household refrigeration appliance 1 also has, for example, two further separate receiving spaces 8 and 9 which are freezer compartments. Moreover, simply one freezer compartment may be present.

The two freezer compartments are also closable in turn by separate doors 10 and 11, wherein also in the exemplary embodiment shown here these doors 10 and 11 are front walls of drawers which are displaceable in a linear manner in the depth direction. Thus it is shown by way of example that the lower freezer compartment is closable by the front wall of a drawer 12 which is designed as a door 11, wherein this drawer 12 is shown here in the pulled-out state.

The receiving spaces 3, 8 and 9 are delimited by an internal container which is designed, in particular, from plastic material.

As may be identified in FIG. 1, the drawer 12, which is adjacent to the front wall which represents the door 11, has a container 13 which is designed for receiving the food.

Figure 2:
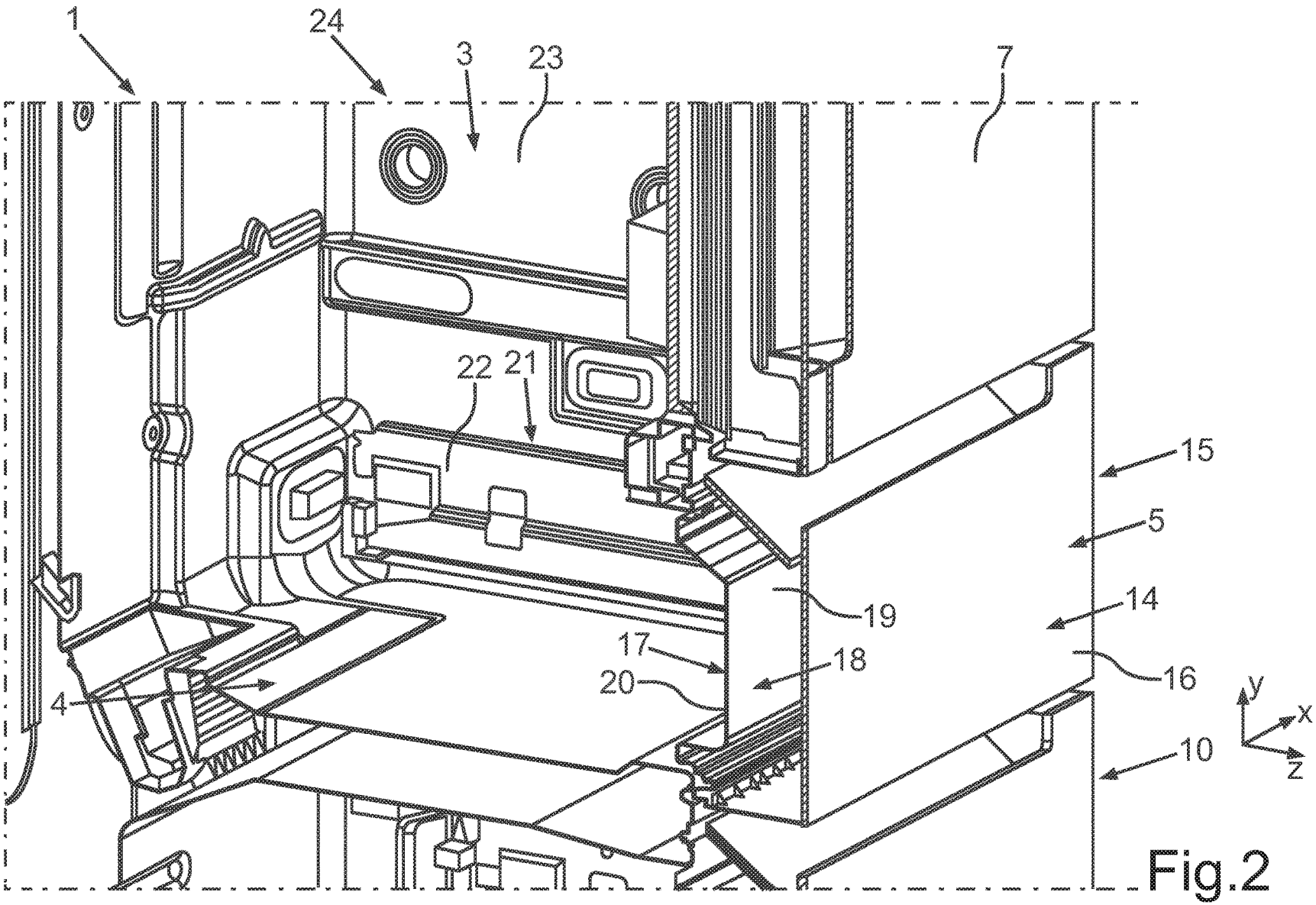
FIG. 2 shows a perspective partial view of the household refrigeration appliance according to FIG. 1.

A partial region of the household refrigeration appliance 1 is shown in FIG. 2 in a perspective sectional view. In particular, in this case the perspective sectional view is shown in the region of the receiving space which in this case is the fresh food compartment 4. The further description may, however, also be provided, for example, in the case of the receiving space 8 or 9 and the drawers therein.

In particular also relating to the receiving space, the fresh food compartment 4 is provided with a drawer, wherein in this case the door 5 constitutes a front wall 14 of the drawer 15.

The front wall 14 which is formed as a door 5, as may be identified in FIG. 2, has an outer wall 16 and an inner wall 17 separate therefrom. The outer wall 16 and the inner wall 17 are arranged spaced apart from one another, so that an intermediate space 18 is formed. Preferably a thermally insulating material, in particular an insulating foam, which is not shown in FIG. 2 for the sake of clarity, is introduced into this intermediate space 18.

The inner wall 17, viewed in the depth direction, is closer to the volume of the fresh food compartment 4 than the outer wall 16. The inner wall 17 which constitutes a wall which delimits a receiving space, in this case the fresh food compartment 4, has an outer side 19 and an inner side 20. The outer side 19 faces away from the volume of the fresh food compartment 4, and faces toward the outer wall 16. The inner side 20 faces toward the volume of the fresh food compartment 4. The outer side 19, therefore, is oriented on the foam side.

As is also indicated in FIG. 2, this drawer 15 may be pushed in and out in a linear manner in the depth direction via a pull-out device 21. In the closed state, as is shown in FIG. 2, the front wall 14 constitutes a visible component and/or an outer part which closes the volume of the fresh food compartment 4 on the front side. The functionality of the door 5 is also provided thereby.

The pull-out device 21 is arranged with a subcomponent, in particular a rail 22, on a side wall 23 of an internal container 24. In this case, the internal container 24 also delimits with its walls the receiving space 3, as has already been set forth above.

Figure 3:
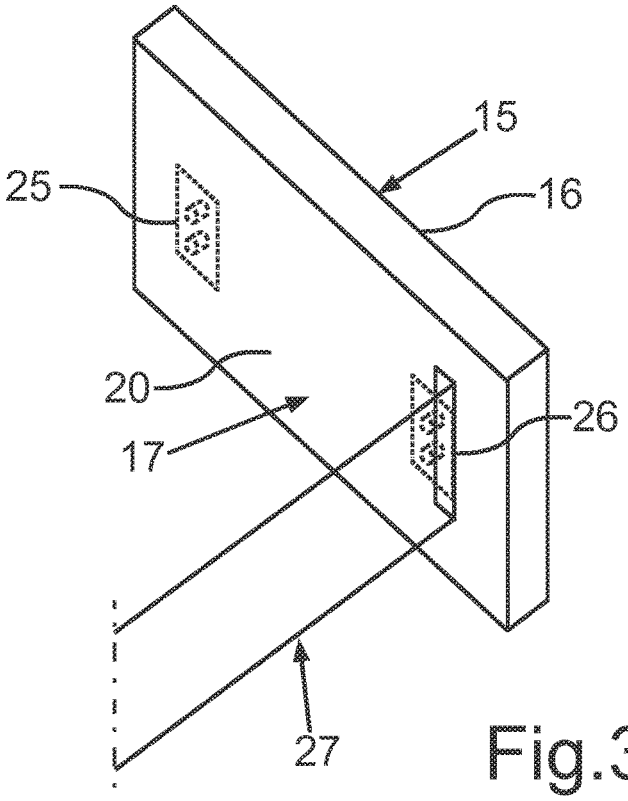
FIG. 3 shows a schematic perspective view of a front wall of a drawer with schematically shown backing parts, wherein a pull-out device is fastened to a backing part.

In FIG. 3, the front wall 14 is shown in a schematic perspective view. It may be identified that in the exemplary embodiment two separate backing parts 25 and 26 are fastened to the inner wall 17, in particular to the outer side 19. In each case, a rail is fastened to these backing parts 25 and 26, in particular screwed thereto. In FIG. 3 only one rail 27 is shown for the sake of clarity. This rail 27 is a pull-out rail which is a component of the pull-out device 21. Here in the coupled state to the rail 22, in particular, a telescopic pull-out device is implemented.

Figure 4:
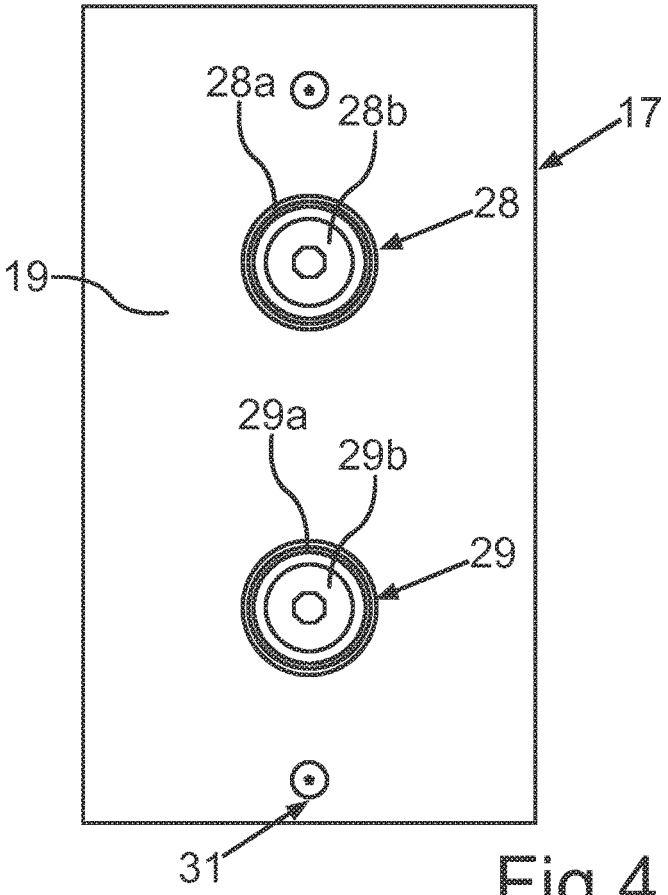
FIG. 4 shows a view of an outer side of a wall on which cups and centering elements which are designed in one piece therewith are shown.

In FIG. 4 a detail of the outer side 19 of the inner wall 17 is shown. As may be identified here, a first counter-coupling element which is designed as a first cup 28 is produced in this inner wall 17. Moreover, spaced apart therefrom and thus as a further separate counter-coupling element, a second cup 29 is designed in an integrated manner and thus in one piece. The two cups 28 and 29 which are also designed, for example, as domes or cupolas, are raised portions which protrude from the plane of this outer side 19. In the embodiment shown, the cups 28 and 29 are formed so as to protrude to the front from the plane of the figures. The cups 28 and 29 are without holes and thus also designed without interruptions, so that the outer side 19 and thus also the entire inner wall 17 in this region do not have a continuous opening.

As may also be identified in FIG. 4 centering elements, in the exemplary embodiment two centering elements 30 and 31, are designed in an integrated manner and thus in one piece on this outer side 19. The centering elements 30 and 31, which are smaller than the cups 28 and 29, are also designed without holes and are raised from the plane of the figures. The cups 28 and 29 are produced by deep-drawing. The same may be provided for the centering elements 30 and 31 which are separate therefrom.

Figure 5:
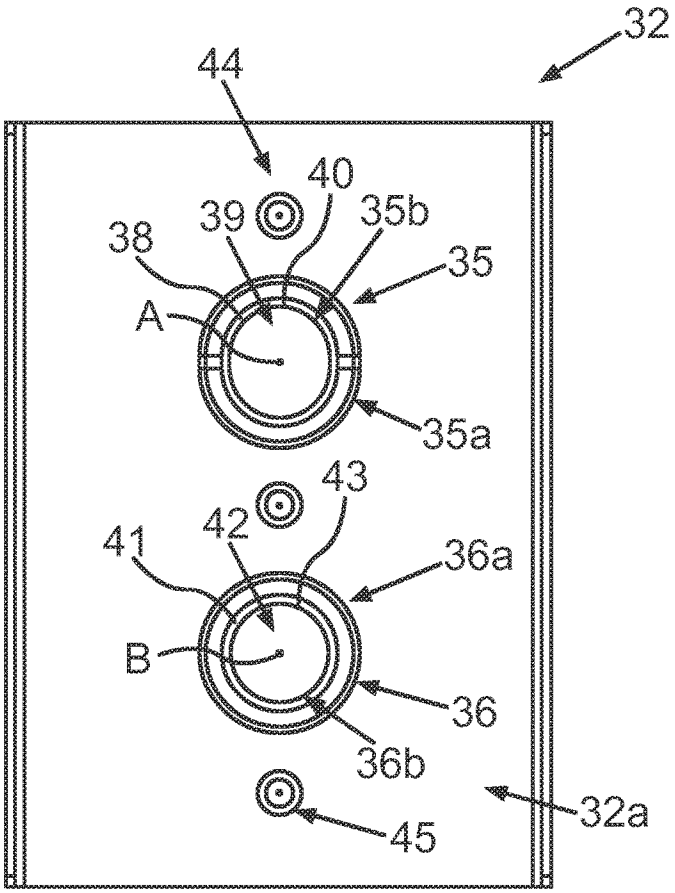
FIG. 5 shows a view of an inner side of an exemplary embodiment of a backing part facing toward the wall.

In FIG. 5 an exemplary embodiment of a backing part is shown. The backing part 32 is shown here by way of example. The backing part is designed in a plate-like manner and has curved projections 33 (FIG. 6) and 34 (FIG. 6) on opposing side edges, in particular longitudinal sides. The backing part 32 has receptacles 35 and 36 as coupling elements in the plate-shaped part. The first receptacle 35 is designed in this case as a hole and the further receptacle 36 which is designed separately and spaced apart therefrom (which forms the further coupling element) is also designed as a hole. As may be identified here, the first hole is designed in funnel-shaped manner, in a hole axis A oriented perpendicular to the plane of the figures. Similarly, the second hole is designed in a funnel-shaped manner, viewed in a hole axis B located perpendicular to the plane of the figures. The funnel shape is provided by a greater clear width being configured at a hole inlet 35*a* than at a hole outlet 35*b*. The same is formed in the second hole, for a hole inlet 36*a* in comparison with a hole outlet 36*b*. As may be identified in the view in FIG. 5, a funnel base 38 which has a cutout 39 is formed by means of this funnel shape in the first hole. This cutout 39 has a defining contour 40 which in this case constitutes an irregular circular shape.

On the other hand, in the exemplary embodiment, the second hole 32 has a funnel base 41 which has a cutout 42. This cutout 42 is delimited by a defining contour 43 which in this case has a circular shape.

Figure 6:
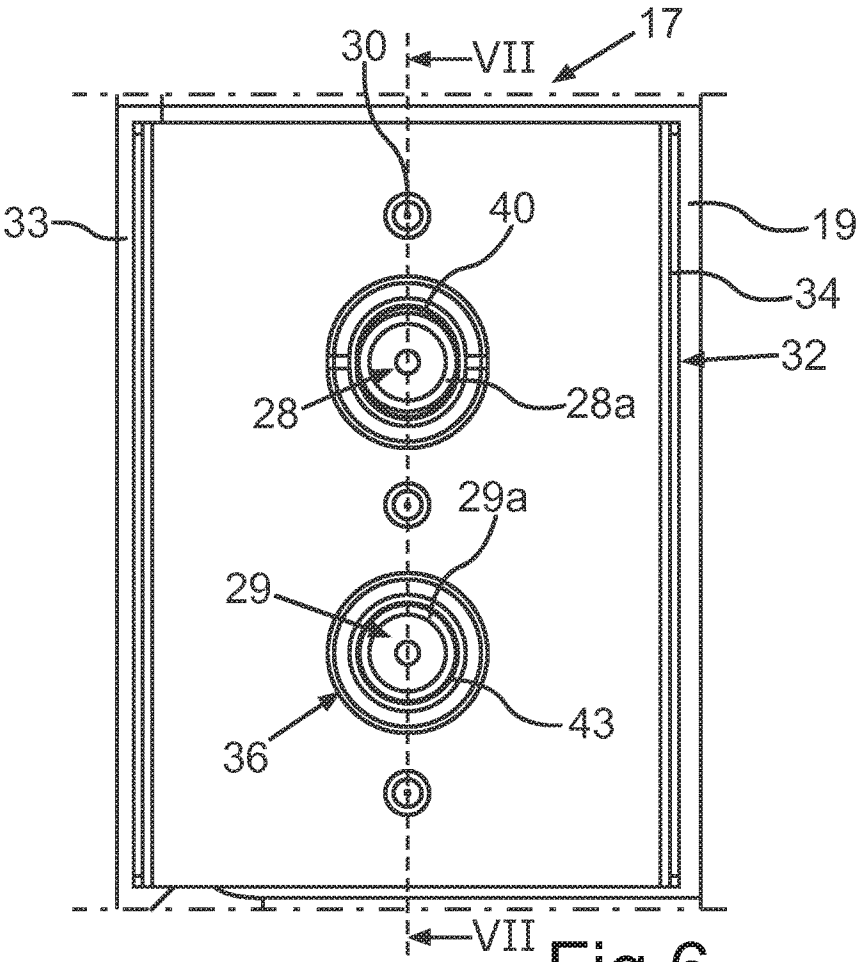
FIG. 6 shows the mounted state of the backing part according to FIG. 5 on the outer side of the wall according to FIG. 4.

Moreover, in this plate-shaped part of the backing part 32 a screw receptacle 44 is designed as a continuous hole, in which the centering element 30 penetrates, as may be identified in the view in FIG. 6. Moreover, in the exemplary embodiment a further screw receptacle 45, which is also designed as a continuous hole, is designed in this backing part 32. In the exemplary embodiment both screw receptacles 44 and 45 have internal threads into which one respective screw, not shown, may be screwed.

In the view in FIG. 4 it may be identified that the first cup 28 has a jacket wall 28*a* which in this case has an annular geometry. A top portion 28*b* of this cup 28 is formed as a convex cover. In the exemplary embodiment it is provided that the second cup 29 also has a jacket wall 29*a* which is formed as an annular geometry, wherein here a top portion 29*b* is also designed as a convex cover. In this exemplary embodiment, the geometries of the cups 28 and 29 are thus, in particular, equal. According to the view in FIG. 5, however, the geometries of the holes are different. In particular, it is provided here that the geometry of the first hole is different from the geometry of the first cup 28 which in the installed state, as is shown also in FIG. 6, penetrates the first hole and is arranged so as to penetrate through the cutout 39. On the other hand, the geometry of the second hole is equal to the geometry of the jacket wall 29*a* of the second cup 29 which in the mounted state penetrates the second hole and is arranged so as to penetrate the cutout 42, as may also be identified in FIG. 6.

In particular, it is provided that the first cup 28 due to its geometry, in particular its jacket wall 28*a*, is arranged in the cutout 39 with asymmetrical play. In particular, it is provided that the second cup 29 with its jacket wall 29*a* is arranged in the cutout 42 of the second hole with symmetrical play, wherein this may also be identified in FIG. 6.

In the aforementioned view in FIG. 6, the backing part 32 bears flat against the outer side 19. In this context, an inner side 32*a* of the plate-shaped part of the backing part 32 is, in particular, additionally bonded to the outer side 19.

In particular, an accurate positioning is possible by the symmetrical minimal play between the jacket wall 29*a* and the contour 43. By the asymmetrical play between the jacket wall 28*a* and the contour 40 to the left and to the right, an accurate positioning is possible and in the view in FIG. 6 play is possible upwardly and downwardly for tolerance compensation.

Figure 7:
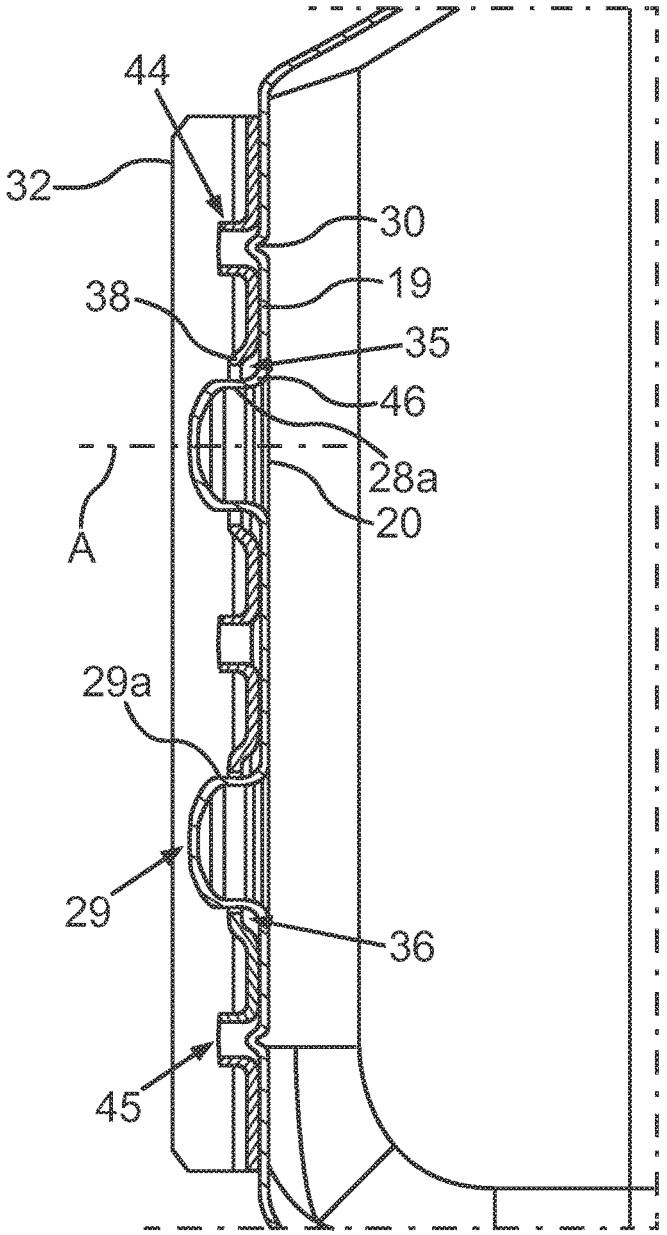
FIG. 7 shows a sectional view through the embodiment according to FIG. 6.

In FIG. 7 a sectional view through the embodiment in FIG. 6 is shown. Here the funnel-shaped design of the hole and of the hole may be identified. Due to this funnel shape it is also achieved that the funnel base 38, viewed in the direction of the axis A, is designed spaced apart from a transition 46 between the jacket wall 28*a* and the outer side 19. Since a radius is formed at this transition 46, in particular due to deep-drawing when producing the cups 28 and 29, this spacing, and in particular as a result the funnel shape of the hole, is advantageous. The same also applies relative to a transition 37 of the cup 29. As may be identified in FIG. 7, therefore, the hole, and correspondingly the hole, is effectively formed by a step and this funnel shape is formed by an individual stamping. Over the entire depth of the hole the wall thickness of the backing part 32 is equal so that the thickness of the funnel base 38 is equal or substantially equal to the material thickness and/or wall thickness of that wall region of the backing part by which the funnel-shaped region of the hole is delimited. The same applies to the hole. As may be identified here, in the exemplary embodiment the centering elements 30 and 31 are formed conically. In FIG. 7 the state is shown in which the backing part 32 is arranged on the outer side 19 but screws are not yet screwed into the screw receptacles 44 and 45 and thus the centering elements 30 and 31 are not yet penetrated by such screws. The screws are screwed in from the inner side 20. This is the side of the inner wall 17 facing away from the screws.

Figure 8:
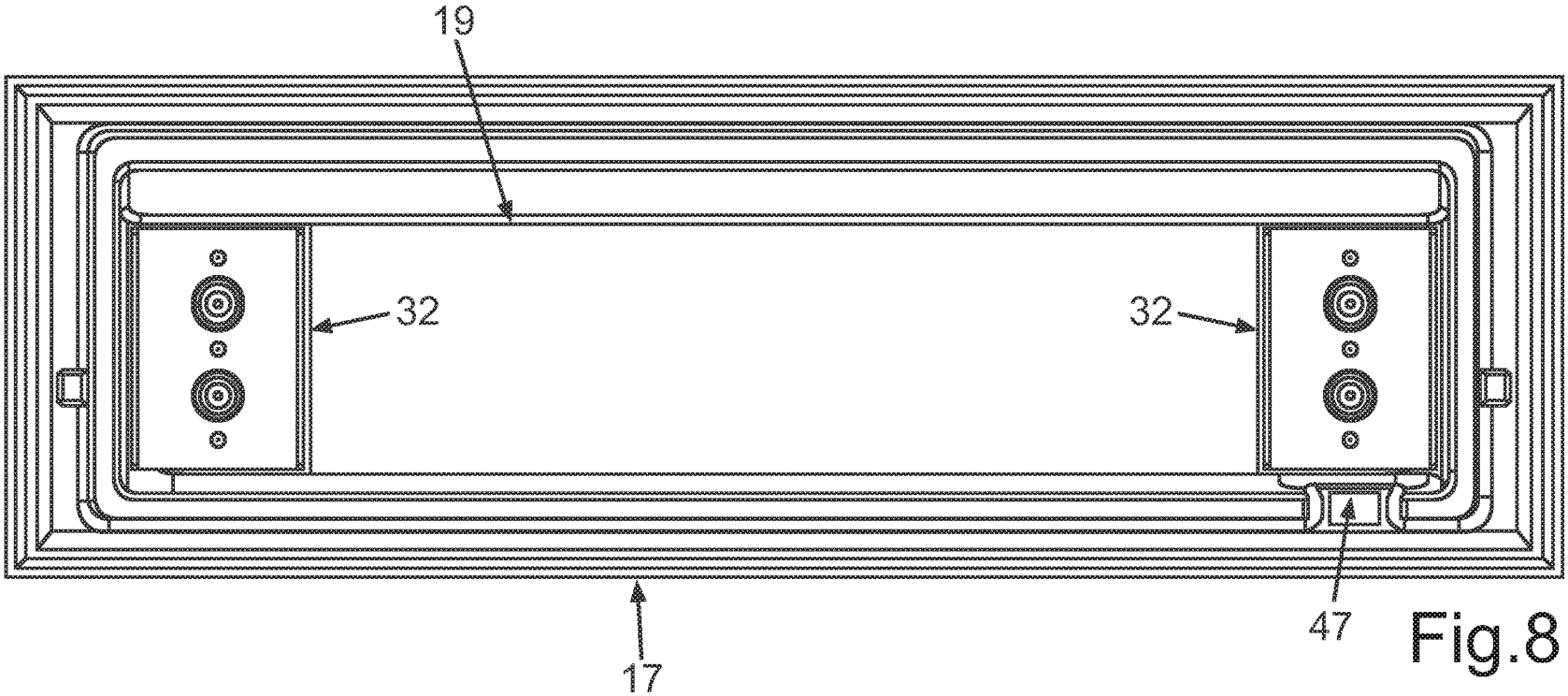
FIG. 8 shows a view of the front wall according to FIG. 3 in a greater degree of detail than in FIG. 3.

In FIG. 8 the inner wall 17 is shown in greater detail than in FIG. 3, wherein a view of the outer side 19 which is the foam side is shown here. Two backing parts 32 may be identified here. Moreover, an opening 47 which is a cable through-passage is designed in this inner wall 17. Here the opening is designed directly below one of the two backing parts 32 in the inner wall 17.

LIST OF REFERENCE NUMERALS

1 Household refrigeration appliance
2 Housing
3 Receiving space
4 Fresh food compartment
5 Door
6 Door
7 Door
8 Receiving space
9 Receiving space
10 Door
11 Door
12 Drawer
13 Container
14 Front wall
15 Drawer
16 Outer wall
17 Inner wall
18 Intermediate space
19 Outer side
20 Inner side
21 Pull-out device

22 Subcomponent
23 Side wall
24 Internal container
25 Backing part
26 Backing part
27 Rail
28 Cup
28*a* Jacket wall
28*b* Top portion
29 Cup
29*a* Jacket wall
29*b* Top portion
30 Centering element
31 Centering element
32 Backing part
32*a* Inner side
33 Projection
34 Projection
35 Receptacle
35*a* Hole inlet
35*b* Hole outlet
36 Receptacle
36*a* Hole inlet
36*b* Hole outlet
37 Transition
38 Funnel-shaped base
39 Cutout
40 Defining contour
41 Funnel-shaped base
42 Cutout
43 Defining contour
44 Screw receptacle
45 Screw receptacle
46 Transition
47 Opening
A Hole axis

The invention claimed is:

1. A household appliance comprising:

walls delimiting a receiving space suitable for receiving food, said walls having an outer side facing away from said receiving space;

a backing plate having a coupling element constructed as a receptacle, said backing plate being metal;

a counter-coupling element disposed on said outer side of one of said walls, said counter-coupling element being constructed as a raised cup without holes, said raised cup being produced by a drawing of said at least one of said walls with said cup standing out from said outer side;

said receptacle being a hole, said hole being funnel-shaped with a funnel base having a cutout for passing said cup through said hole, an edge of a boundary limiting said cutout being spaced apart from said outer side in a direction in which said cup extends, a wall thickness of said backing plate, in wall regions delimiting said hole, being substantially equal over an entire depth of said funnel-shaped hole;

said raised cup being extended through and coupled to said receptacle upon mounting said backing plate on said outer side of said one wall in a mounted state with said backing plate bearing flat against said outer side.

2. The household appliance according to claim 1, wherein said cup is cupola-shaped or dome-shaped.

3. The household appliance according to claim 1, wherein said funnel shape is formed by a stamped step in said one wall.

4. The household appliance according to claim 1, wherein said cup is one of at least two separate cups being mutually spaced apart and integrated in said outer side of said one wall, and said hole is one of at least two separate holes in said backing plate corresponding in number to said cups.

5. The household appliance according to claim 4, wherein said holes have different geometries or said cups have different geometries.

6. The household appliance according to claim 5, wherein:

one of said holes forming one of said receptacles has a cutout with a circular geometry for passage of a cup; and a further of said holes forming a further of said receptacles has a cutout with an irregular circular shape for passage of another cup.

7. The household appliance according to claim 5, wherein:

one of said cups has a jacket wall with an annular geometry; and a further one of said cups has a jacket wall with an irregular annular geometry or an annular geometry.

8. The household appliance according to claim 4, wherein one of said receptacles and one of said cups are coupled with asymmetrical play, and a further one of said receptacles and a further one of said cups are coupled with symmetrical play.

9. The household appliance according to claim 8, which further comprises:

a screw receptacle being separate from a coupling element, said screw receptacle being formed in said backing plate for screwing in a screw; and a raised centering element being integrally formed in said one wall and penetrating said screw receptacle, permitting the screw to be screwed through said centering element.

10. The household appliance according to claim 1, which further comprises:

a drawer being mounted to permit said drawer to be pushed into and pulled out of said receiving space;

said drawer having a front wall closing a front side of said receiving space in a pushed-in state;

said front wall having an inner wall facing toward said receiving space; and said inner wall having said outer side facing away from said receiving space and receiving said plate.

11. The household appliance according to claim 1, which further comprises a rail fastened to said backing plate.

12. A method for mounting a backing plate on a wall of a household appliance, the method comprising:

providing a receiving space delimited by the wall of the household appliance;

providing the backing plate as a metal backing plate;

providing a coupling element constructed as a receptacle on the backing plate;

providing a counter-coupling element constructed as a raised cup without holes on an outer side of the wall facing away from the receiving space, the raised cup being produced by a drawing of the wall with the cup standing out from said outer side; and the receptacle being a hole, the hole being funnel-shaped with a funnel base having a cutout for passing the cup through the hole, an edge of a boundary limiting the cutout being spaced apart from the outer side in a direction in which the cup extends, a wall thickness of the backing plate, in wall regions delimiting the hole, being substantially equal over an entire depth of the funnel-shaped hole;

inserting and coupling the raised cup into the receptacle for mounting the backing plate on the outer side of the wall with the backing plate bearing flat against the outer side.

13. The method according to claim 12, which further comprises:

providing a screw receptacle in the backing plate, separate from a coupling element, for screwing in a screw;

providing a raised centering element without holes integrally in the wall;

inserting the raised centering element into the screw receptacle; and subsequently inserting a screw into the centering element and screwing the screw into the screw receptacle.

* * * * *